US009389034B2

(12) United States Patent
Langevin et al.

(10) Patent No.: US 9,389,034 B2
(45) Date of Patent: Jul. 12, 2016

(54) GAS REGULATOR FOR A FIREARM AND FIREARM WITH GAS REGULATOR

(75) Inventors: Kevin Richard Langevin, Berlin, CT (US); Michael Andrew Josey, Farmington, CT (US)

(73) Assignee: COLT'S MANUFACTURING IP HOLDING COMPANY LLC, West Hartford, CT (US)

( * ) Notice: Subject to any disclaimer, the term of this patent is extended or adjusted under 35 U.S.C. 154(b) by 77 days.

(21) Appl. No.: 13/524,577

(22) Filed: Jun. 15, 2012

(65) Prior Publication Data

US 2013/0174721 A1 Jul. 11, 2013

Related U.S. Application Data

(60) Provisional application No. 61/498,226, filed on Jun. 17, 2011, provisional application No. 61/594,075, filed on Feb. 2, 2012.

(51) Int. Cl.

| | |
|---|---|
| ***F41A 5/18*** | (2006.01) |
| ***F41G 1/033*** | (2006.01) |
| ***F41G 1/00*** | (2006.01) |
| ***F41A 5/28*** | (2006.01) |

(52) U.S. Cl.
CPC ... *F41A 5/18* (2013.01); *F41A 5/28* (2013.01); *F41G 1/00* (2013.01); *F41G 1/033* (2013.01)

(58) Field of Classification Search
CPC ..... F41A 5/18; F41A 5/26; F41A 5/28; F41G 1/00; F41G 1/033
USPC ..... 89/191.01–193
See application file for complete search history.

(56) References Cited

U.S. PATENT DOCUMENTS

| | | | | |
|---|---|---|---|---|
| 795,468 | A | 7/1905 | Windridge | |
| 1,431,059 | A * | 10/1922 | Sutter | 89/193 |
| 2,032,648 | A | 3/1936 | Bliss | |
| 4,021,954 | A | 5/1977 | Crawford | |
| 4,102,243 | A | 7/1978 | Jennie | |
| 4,244,273 | A | 1/1981 | Langendorfer, Jr. et al. | |
| 5,577,326 | A | 11/1996 | Montelin | |
| 5,726,377 | A | 3/1998 | Harris et al. | |
| 5,945,626 | A | 8/1999 | Robbins | |
| 6,327,807 | B1 | 12/2001 | Bergacker | |

(Continued)

FOREIGN PATENT DOCUMENTS

| | | |
|---|---|---|
| DE | 102005043653 A1 | 3/2007 |
| JP | 2010-249339 A | 4/2010 |

(Continued)

OTHER PUBLICATIONS

International Search Report for International Application No. PCT/US2012/042711; International Filing Date: Jun. 15, 2012; Date of Mailing: May 29, 2013.

(Continued)

*Primary Examiner* — Stephen M Johnson
*Assistant Examiner* — Benjamin Gomberg
(74) *Attorney, Agent, or Firm* — Cantor Colburn LLP

(57) ABSTRACT

A gas regulator for a rifle is provided, the gas regulator having: an elongated member having a first end and a second end; a head portion located at the first end; a pair of openings passing through the elongated member, wherein one of the pair of openings is larger than the other one of the pair of openings; and a recessed area located at the second end.

10 Claims, 14 Drawing Sheets

(56) References Cited

U.S. PATENT DOCUMENTS

| | | | | |
|---|---|---|---|---|
| 6,779,290 | B1 | 8/2004 | Houtsma | |
| 7,131,228 | B2 | 11/2006 | Hochstrate et al. | |
| 7,367,152 | B2 | 5/2008 | Samson | |
| 7,610,844 | B2 | 11/2009 | Kuczynko et al. | |
| 7,775,150 | B2 | 8/2010 | Hochstrate et al. | |
| 7,934,447 | B2 | 5/2011 | Kuczynko et al. | |
| 7,938,055 | B2 | 5/2011 | Hochstrate et al. | |
| 7,946,074 | B2 | 5/2011 | Nemec | |
| 8,596,185 | B1 * | 12/2013 | Soong | F41A 5/28 89/193 |
| 2004/0226213 | A1 | 11/2004 | Woodbury | |
| 2005/0188602 | A1 | 9/2005 | Swan | |
| 2006/0065112 | A1 | 3/2006 | Kuczynko et al. | |
| 2007/0199435 | A1 | 8/2007 | Hochstrate et al. | |
| 2009/0007478 | A1 | 1/2009 | Fluhr et al. | |
| 2009/0241400 | A1 * | 10/2009 | Stumpp | 42/140 |
| 2010/0000400 | A1 | 1/2010 | Brown | |
| 2010/0095834 | A1 * | 4/2010 | Kuczynko et al. | 89/193 |
| 2010/0275770 | A1 | 11/2010 | Noveske | |
| 2010/0319528 | A1 | 12/2010 | Kenney et al. | |
| 2011/0023699 | A1 | 2/2011 | Barrett | |
| 2012/0152104 | A1 | 6/2012 | Audibert et al. | |
| 2012/0180368 | A1 | 7/2012 | Haley et al. | |
| 2012/0297970 | A1 | 11/2012 | Langevin et al. | |

FOREIGN PATENT DOCUMENTS

| | | | |
|---|---|---|---|
| KR | 2019900010507 | Y1 | 11/1990 |
| WO | 9507444 | A1 | 3/1995 |
| WO | 2008014986 | A1 | 2/2008 |
| WO | 2010030987 | A1 | 3/2010 |

OTHER PUBLICATIONS

Written Opinion for International Application No. PCT/US2012/042711; International Filing Date: Jun. 15, 2012; Date of Mailing: May 29, 2013.

English Abstract JP 2010249339 (A) Nov. 4, 2010.

International Search Report dated Jan. 31, 2013 for International Application No. PCT/US2012/042709.

Written Opinion dated Jan. 31, 2013 for International Application No. PCT/US2012/042709.

International Preliminary Report for International Application No. PCT/US2012/042709; Date of Mailing: Jan. 31, 2014.

Supplementary European Search Report dated Sep. 30, 2014 for Application No. PCT/US2012042709.

Supplementary European Search Report dated Sep. 30, 2014 for Application No. PCT/US2012042711.

* cited by examiner

GAS REGULATOR FOR A FIREARM AND FIREARM WITH GAS REGULATOR

CROSS REFERENCE TO RELATED APPLICATIONS

This application claims the benefit of U.S. Provisional Patent Application Ser. No. 61/498,226 filed Jun. 17, 2011, the contents of which are incorporated herein by reference thereto.

This application also claims the benefit of U.S. Provisional Patent Application Ser. No. 61/594,075 filed Feb. 2, 2012, the contents of which are incorporated herein by reference thereto.

BACKGROUND

Various embodiments of the present invention relate generally to a rifle or firearm and in particular, a gas regulator for a firearm. Still other embodiments relate generally to a rifle or firearm and in particular, a locking sight for a firearm.

Folding or collapsible sights are desirable for weapons in that the same allows the sight to transition from a first folded or stowed position to a second extended or deployed position. In one application, the first folded or stowed position allows the sight to be configured or located in a position that does not interfere with an optical sighting system or accessory that is mounted to a rail of the weapon. However, folding or collapsible sights may be inadvertently moved from the deployed position. Accordingly, it is desirable to provide a folding or collapsible sight with a locking mechanism that prevents inadvertent movement of the sight A flash suppressor and/or a sound suppressor used with a firearm or rifle will increase the rate of fire or cycling of the firearm. This increase in cycling may also increase the wear rate of components of the firearm. In addition, variations in the types of ammunition used with rifle will also vary the cycling rate of the rifle and a rifle configured for use with one type of ammunition may cycle too fast when fired with another type of ammunition thus causing the aforementioned excessive wear to the components of the rifle. Non-limiting examples of different types of ammunition are 5.56 mm NATO ammunition and 223 Remington ammunition each of which may provide different cycling rates when fired from a rifle having the same gas port configuration in a gas impingement system. Still further there are reliability issues associated with higher cycling rates when ammunition is changed for example, round feeding may not occur or may occur improperly.

Accordingly, it is desirable to provide an apparatus and method for regulating the gas pressure in a rifle and thus allowing the same to be configured for use with suppressors and various types of ammunition.

SUMMARY OF THE INVENTION

In one exemplary embodiment a gas regulator for a rifle is provided, the gas regulator having: an elongated member having a first end and a second end; a head portion located at the first end; a pair of openings passing through the elongated member, wherein one of the pair of openings is larger than the other one of the pair of openings; and a recessed area located at the second end.

In another exemplary embodiment a gas block for a rifle is provided, the gas block having: a gas regulator having a first end and a second end; a pair of openings passing through the gas regulator, wherein one of the pair of openings is larger than the other one of the pair of openings; and wherein the gas regulator is slidably received within an opening of the gas block for movement between a first position and a second position, wherein one of the pair of openings through the gas regulator provides fluid communication between a pair of openings in the gas block when the gas regulator is in the first position and another one of the pair of openings through the gas regulator provides fluid communication between the pair of openings in the gas block when the gas regulator is in the second position.

In yet another embodiment a rifle is provided, the rifle having: a barrel; a gas block having a pair of openings wherein one of the pair of openings is in fluid communication with the barrel; a gas regulator having a first end and a second end; a pair of openings passing through the gas regulator, wherein one of the pair of openings is larger than the other one of the pair of openings; and wherein the gas regulator is slidably received within an opening of the gas block for movement between a first position and a second position, wherein one of the pair of openings through the gas regulator provides fluid communication between the pair of openings in the gas block when the gas regulator is in the first position and another one of the pair of openings through the gas regulator provides fluid communication between the pair of openings in the gas block when the elongated member is in the second position.

Other aspects and features of embodiments of the invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein:

FIGS. 6-9C are views of a locking front sight in accordance with an alternative exemplary embodiment of the present invention;

DETAILED DESCRIPTION

Reference is made to the following U.S. Pat. Nos. 6,792,711; 7,131,228; and 7,775,150 the contents each of which are incorporated herein by reference thereto. Reference is made to the following pending U.S. Provisional Patent Application Ser. No. 61/481,697, filed May 2, 2011 and U.S. Non-Provisional patent application Ser. No. 13/462,346, filed May 2, 2012, the contents each of which are incorporated herein by reference thereto.

Disclosed herein is an apparatus, method and system for providing a locking sight for a rifle or firearm to provide various sight positions.

Referring now to the attached FIGS. a locking sight 10 of a firearm is illustrated. Of course, aspects of this invention may be applied to other sights such as rear sights, etc. In one exemplary embodiment, the locking sight is a front sight of a firearm. As illustrated, the locking front sight 10 has a mounting block or gas block 12 that is mounted to an upper receiver of the firearm or weapon.

Figure 1:
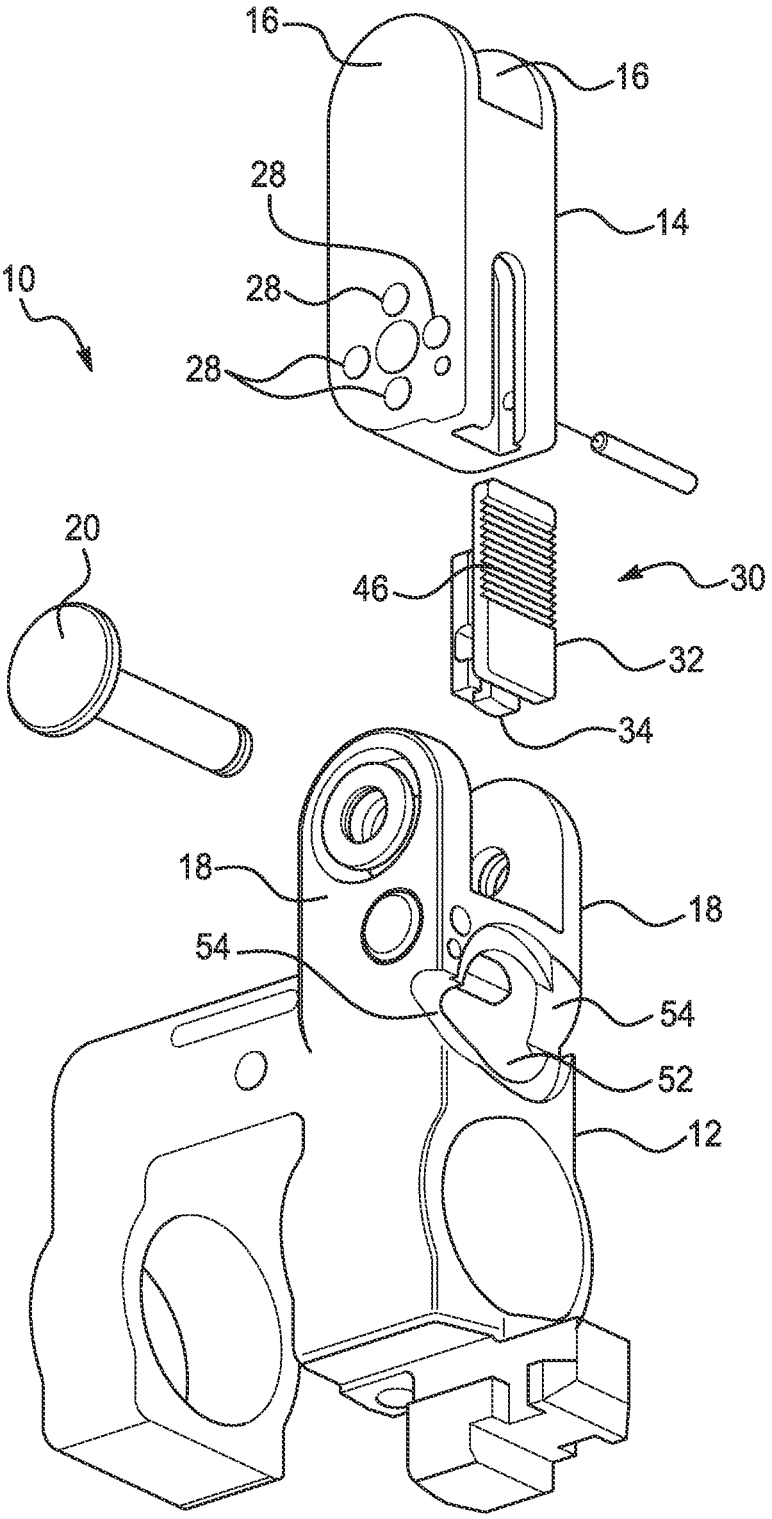
FIG. 1 is an exploded perspective view of a locking front sight in accordance with an exemplary embodiment of the present invention.
Figure 2:
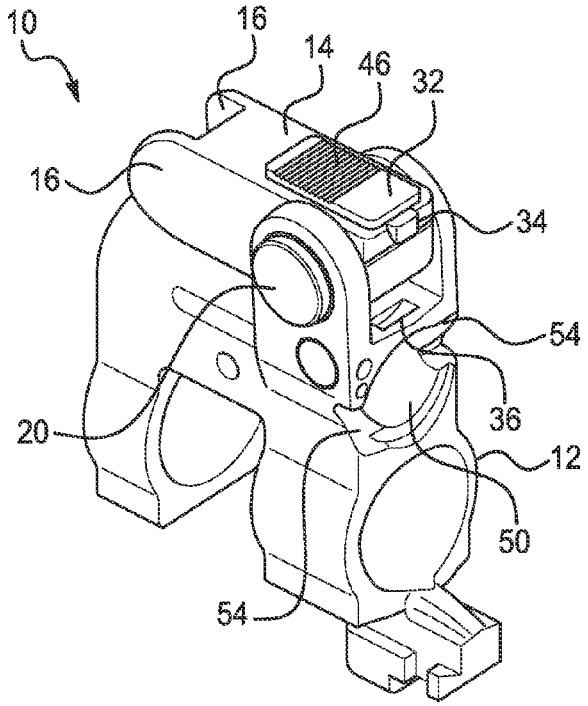
FIG. 2 is a perspective view of a locking front sight in a first position in accordance with an exemplary embodiment of the present invention.
Figure 2A:
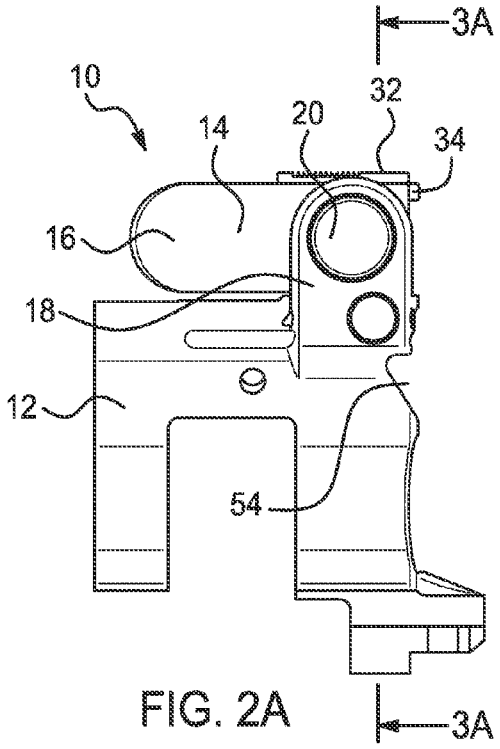
FIG. 2A is a left side view of the locking front sight in the first position.
Figure 2B:
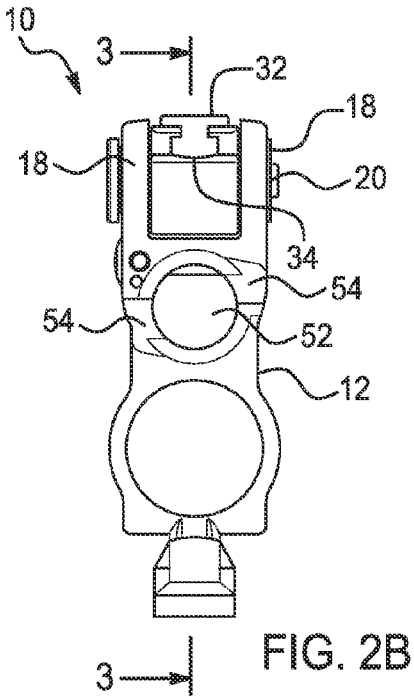
FIG. 2B is a front view of the locking front sight in the first position.
Figure 3:
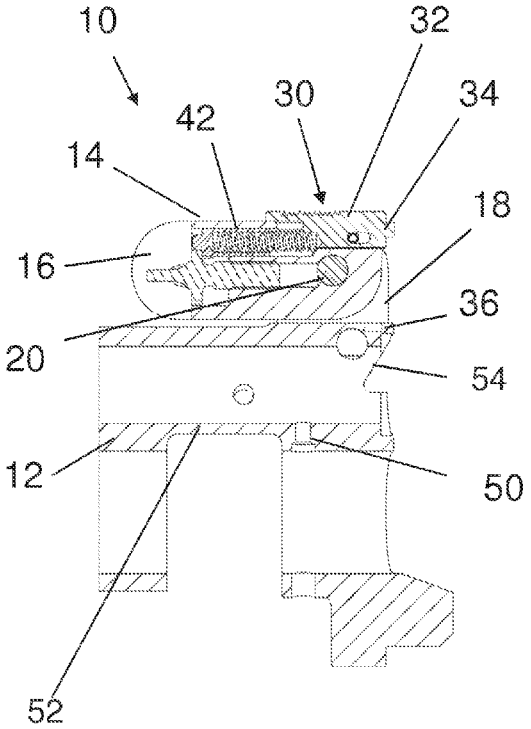
FIG. 3 is a view along lines 3-3 of FIG. 2B.
Figure 3A:
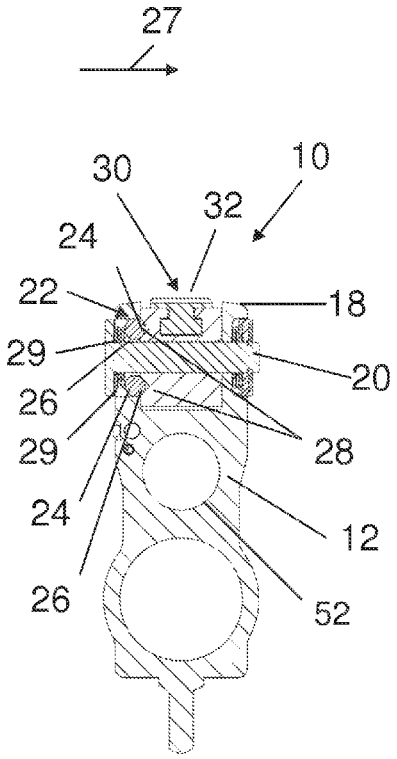
FIG. 3A is a view along lines 3A-3A of FIG. 2A.
Figure 4:
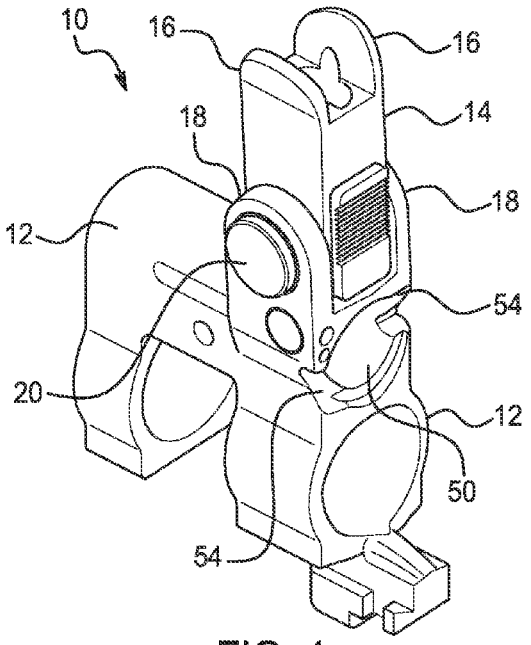
FIG. 4 is a perspective view of a locking front sight in a second position in accordance with an exemplary embodiment of the present invention.
Figure 4A:
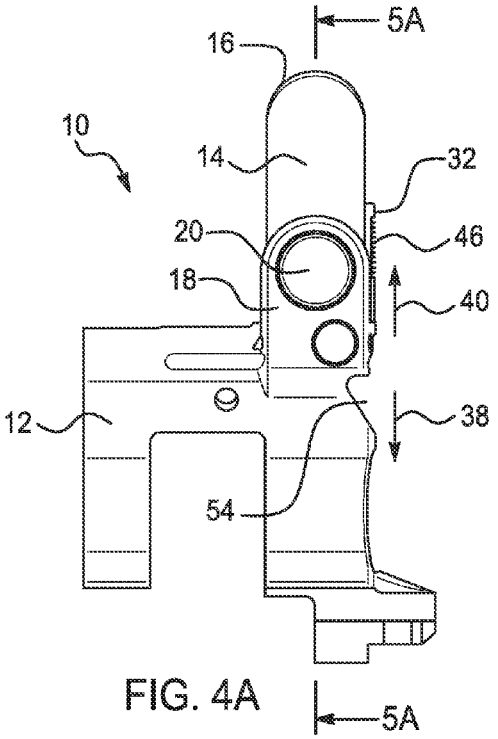
FIG. 4A is a left side view of the locking front sight in the second position.
Figure 4B:
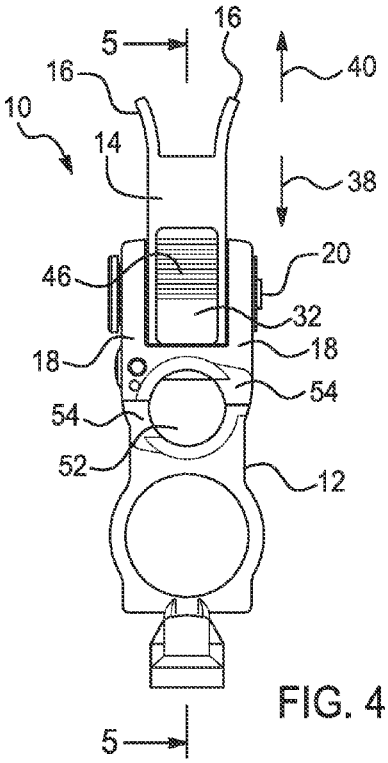
FIG. 4B is a front view of the locking front sight in the second position.
Figure 5:
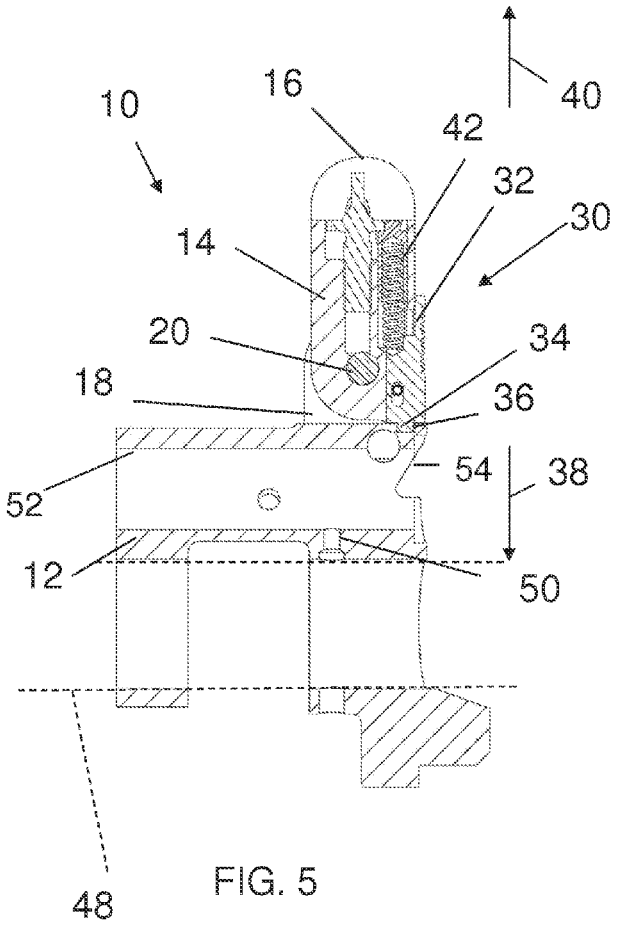
FIG. 5 is a view along lines 5-5 of FIG. 4B.
Figure 5A:
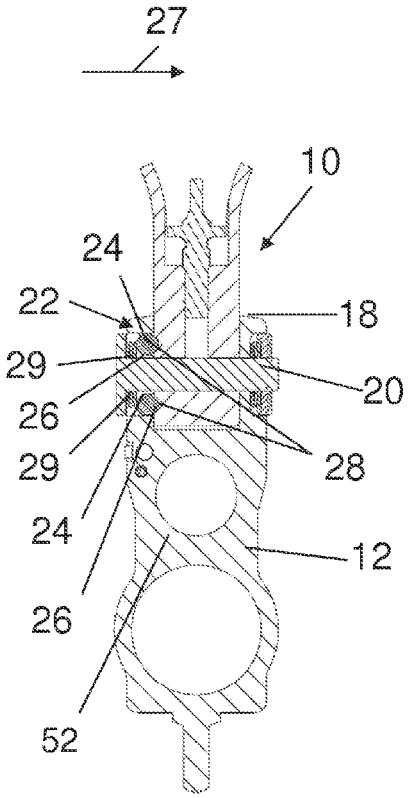
FIG. 5A is a view along lines 5A-5A of FIG. 4A.
Figure 6:
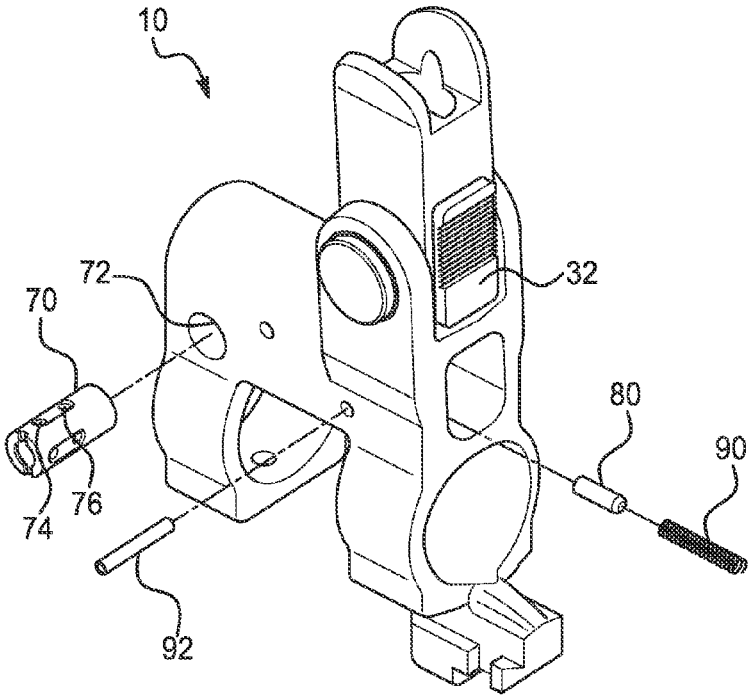
Figure 7:
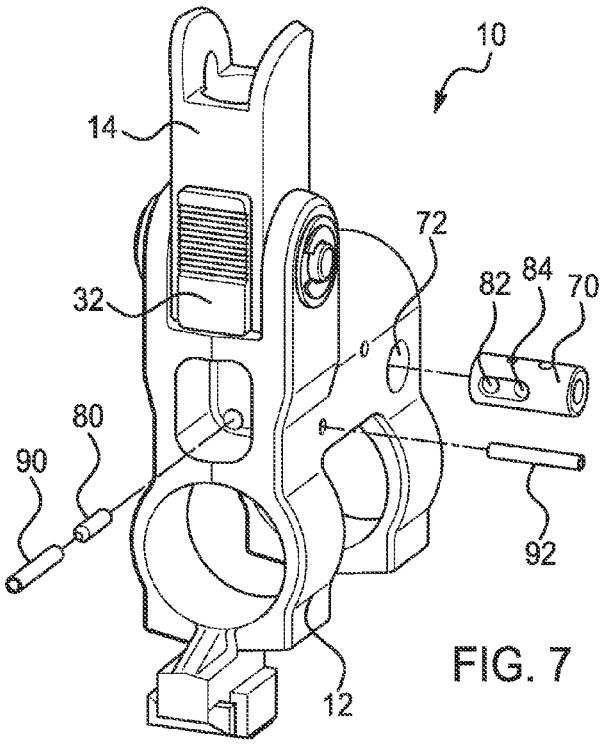

A sight tower 14 is pivotally mounted to the mounting block or gas block 12 for movement between a first position FIGS. 1-3 and a second position FIGS. 4-5. The sight tower 14 has a pair of tabs or ears 16. As illustrated, a lower portion of the sight tower 14 is received within a pair of wall members 18 of the mounting block 12. A pin or shaft 20 secures the lower portion of the sight tower 14 to the pair of wall members 18. Pin or shaft 20 passes through openings in wall members 18 and the lower portion of the sight tower such that the sight tower can be moved between the first and second positions.

In order to retain the sight tower in either the first position or the second position, a first locking mechanism 22 is provided. In one embodiment, the first locking mechanism 22 is a plurality of spring biased members 24 that are received within complimentary openings 26 of the wall members 18. The lower portion of the sight tower has a plurality of recessed features 28 on an exterior surface of the sight tower such that when the sight tower is in either the first or second position the plurality of spring biased members 24 extend outwardly away from wall member 18 such that a portion of each of the spring biased members is partially received within openings 26 and recessed features 28 such that the sight tower is locked in either the first position or the second position. In one embodiment, the spring biased members 24 are a plurality of balls each being biased in a first direction 27 by a spring 29.

In one non-limiting exemplary embodiment, the spring biased members 24 are only located in one wall member 18. Of course, alternative configurations are contemplated wherein the spring biased members 24 are located in both wall members 18 and are configured to engage complimentary openings or recessed features 28 on a surface of the sight tower. In addition and in one non-limiting exemplary embodiment, the openings or recessed features 28 are offset 90 degrees from each other to define the first position and the second position of the sight tower. Of course other orientations and configurations are contemplated.

In order to move the sight tower from either the first or second position, a force is applied to the sight tower such that the spring biased features are pushed back into the openings 24 of the wall member or members 18 and the tower can be repositioned from either the first or second position. Accordingly, the first lock mechanism 22 releasably retains the sight tower in either the first or second position. However, an applied force to the tower may be sufficient to overcome the biasing force applied to the spring biased members 24 and cause the tower to move between the first position and the second position, whether this is intentional or unintentional (e.g., sight tower inadvertently contacts a surface as opposed to a deliberate user applied force).

In order to retain the sight tower in second position, a second locking mechanism 30 is provided. The second locking mechanism is configured to lock the tower in the second position, wherein the second locking mechanism must be manually released or disengaged before the tower can be moved from the second position to the first position. In one non-limiting embodiment, the second locking mechanism is a spring biased catch or member 32 having a tab portion or feature 34 that is configured to engage a slot or opening 36 of the mounting block when the sight tower is in the first position.

In one embodiment, the catch or member 32 is slidably mounted to the sight tower for movement in the direction of arrows 38 and 40 with respect to the sight tower 14. The catch or member 32 is biased in the direction of arrow 38 by a spring 42 such that as the sight tower is rotated into the second position, tab or feature 34 of the catch or member 32 is received within the slot or opening 36 and the sight tower 14 is locked in the second position. Accordingly, the sight tower 14 cannot be moved from the second position to the first position unless catch or member 32 is moved upwardly in the direction of arrow 40 against the biasing force of the spring 42.

In the illustrated embodiment, the catch or member is slidably mounted to the front end of the sight tower 14 and has a surface 46 that is configured to frictionally engage a user's finger or thumb in order to move the catch or member 32 in the direction of arrow 40 wherein the sight tower can be pivoted or rotated from the second or locked position towards the first position.

Once moved upwardly in the direction of arrow 40, the tab member or catch 32 is removed from the slot or opening 36 such that the tab member or catch 32 is no longer received within slot or opening 36 and the sight tower can be pivoted from the second position towards the first position when the tab member or catch is moved out of slot or opening 36.

Thereafter and when the sight tower is moved away from the second position it can once again be repositioned into the second position, wherein the first locking mechanism and the second locking mechanism retain the sight tower in the second position.

In one exemplary embodiment, the mounting block or gas block 12 is configured to be in fluid communication with a bore of a barrel 48 via an opening 50 that is fluidly coupled to a complementary opening of the barrel such that locking front sight can be used in with a gas operating system for a firearm. Non-limiting examples of such systems are described in the following U.S. Pat. Nos. 5,726,377; 5,945,626; 7,610,844; 7,934,447; and 7,938,055 the contents each of which are incorporated herein by reference thereto. Still further reference is made to the following pending U.S. patent application Ser. No. 12/559,047 filed Sep. 14, 2009, the contents of which is incorporated herein by reference thereto. In addition the following PCT application WO 2010/030987 is also incorporated herein by reference thereto.

In one non-limiting exemplary embodiment an opening or bore 52 is provided to receive a sleeve (not shown) that fluidly couples opening 50 to the gas operating system. In one embodiment the sleeve is configured to be received in bore 52 in at least two orientations (e.g., 180 degrees off set from each other of course other orientations are contemplated) wherein one of two different sized orifices or openings is fluidly coupled to opening 50 and the other is not. Thus, a user is able to remove, rotate and replace the sleeve in at least two orientations that vary the gas pressure of the gas operating system by varying the size of the orifice coupling the bore to the gas operating system.

As mentioned above this is particularly useful when a rifle is used with or without a suppressor and/or wherein the types of ammunition fired from the rifle is varied.

In one embodiment, the sleeve is also configured to engage at least one of a pair of cam surfaces 54 located on a forward end of the gas block or mounting block 12 of the locking front sight 10. The cam surfaces 54 are located on opposite sides of the bore 52 and are configured to engage a complementary feature of the sleeve such that rotation of the sleeve in bore 52 in one direction will cause the sleeve to move out of the forward end on the gas block or mounting block 12. The pair of cam surfaces 54 are provided to allow for the sleeve to be in the aforementioned at least two orientations such that different sized openings can be selectively placed in fluid communication with the opening 50 to vary gas pressures and accordingly the cycling rate of the gas operating system.

In one embodiment and depending on the orientation of the sleeve in the bore 52, only one of the cam surfaces 54 will engage the feature of the sleeve as it is rotated therein and the other one of the cam surfaces will engage the feature of the sleeve when the sleeve is inserted into the bore in an opposite orientation. In other words and in one non-limiting embodiment, when the sleeve is in a first orientation providing fluid communication with opening 50 with a first sized orifice only one of the cam surfaces will engage the feature of the sleeve thereafter and when the sleeve is removed and replaced into the bore 52 in a second different orientation such that a second sized orifice, different from the first, is in fluid communication with opening 50 and only the other one of the cam surfaces will make contact with the feature of the sleeve as it is rotated in bore 52. In one non-limiting configuration one of the cam surfaces is on one side of bore 52 and is inclined upwardly in a first direction while the other one of the cam surfaces is on an opposite side of the bore and is inclined downward in a second direction, which is in essence opposite to the first direction. Of course, numerous other configurations and orientations are contemplated and exemplary embodiments of the present invention contemplate variations of the configurations illustrated in the attached drawings. It is understood that the sleeve of the embodiment of FIGS. 1-5A can be used alone or in combination with the locking front sight 10. In other words, gas block 12 may be configured with or without locking front sight 10.

Referring now to FIGS. 6-9C, an alternative exemplary embodiment of the locking front sight 10 is illustrated. Here, the mounting block or gas block 12 is configured to slidably receive a gas regulator 70 in an opening 72 of the mounting block or gas block 12. As illustrated, the gas regulator 70 is capable of movement in the direction of arrows 71 within opening 72. Gas regulator 70 provides a means for fluidly coupling opening 50 to a gas operating system of the firearm in a manner such that an orifice or opening coupling the bore of the barrel to the gas operating system can be varied such that the cycling rate of the firearm can be varied. In this embodiment, the gas regulator 70 has two openings 74 and 76 each of which has a different size or diameter thus varying the gas pressures or fluid communication between the barrel and the gas operating system if the firearm.

Figures 8A, 8B, 8C:
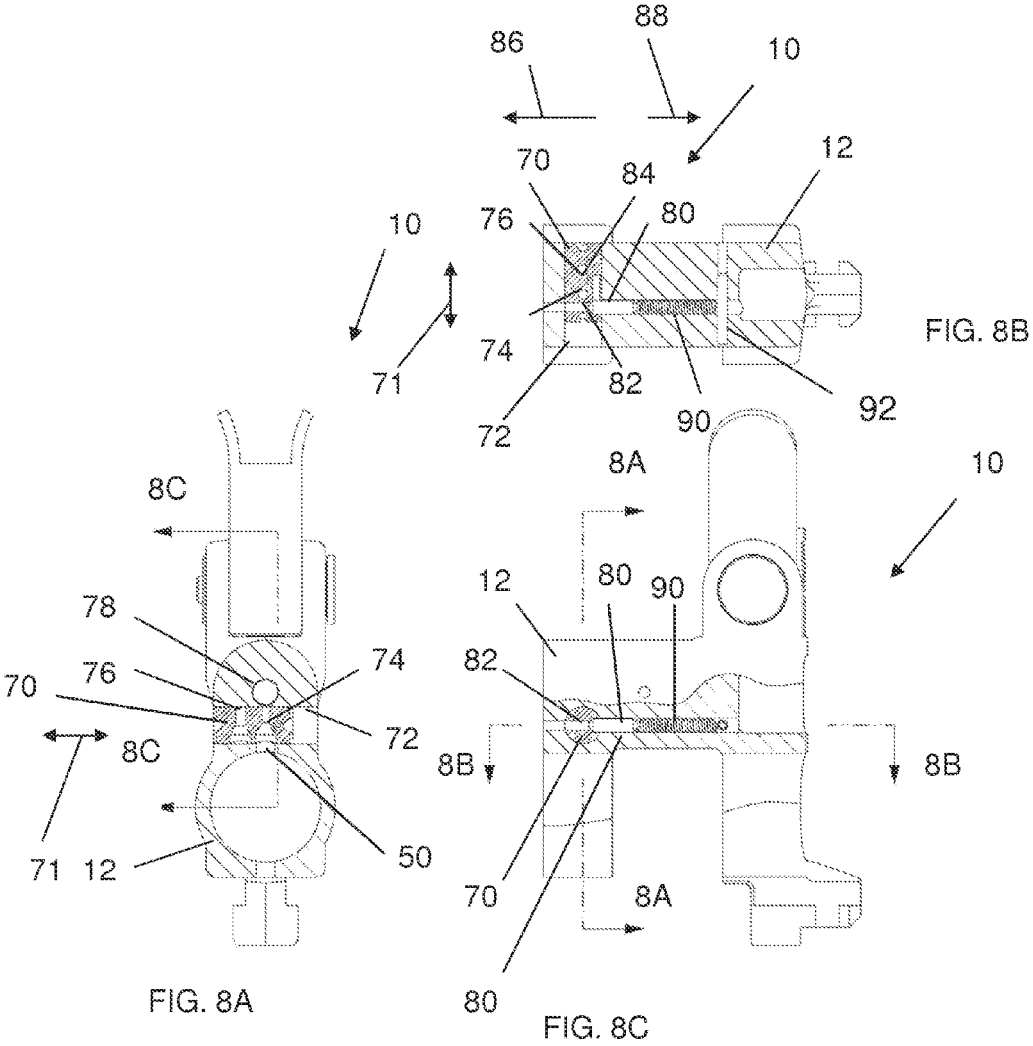
Figures 9A, 9B, 9C:
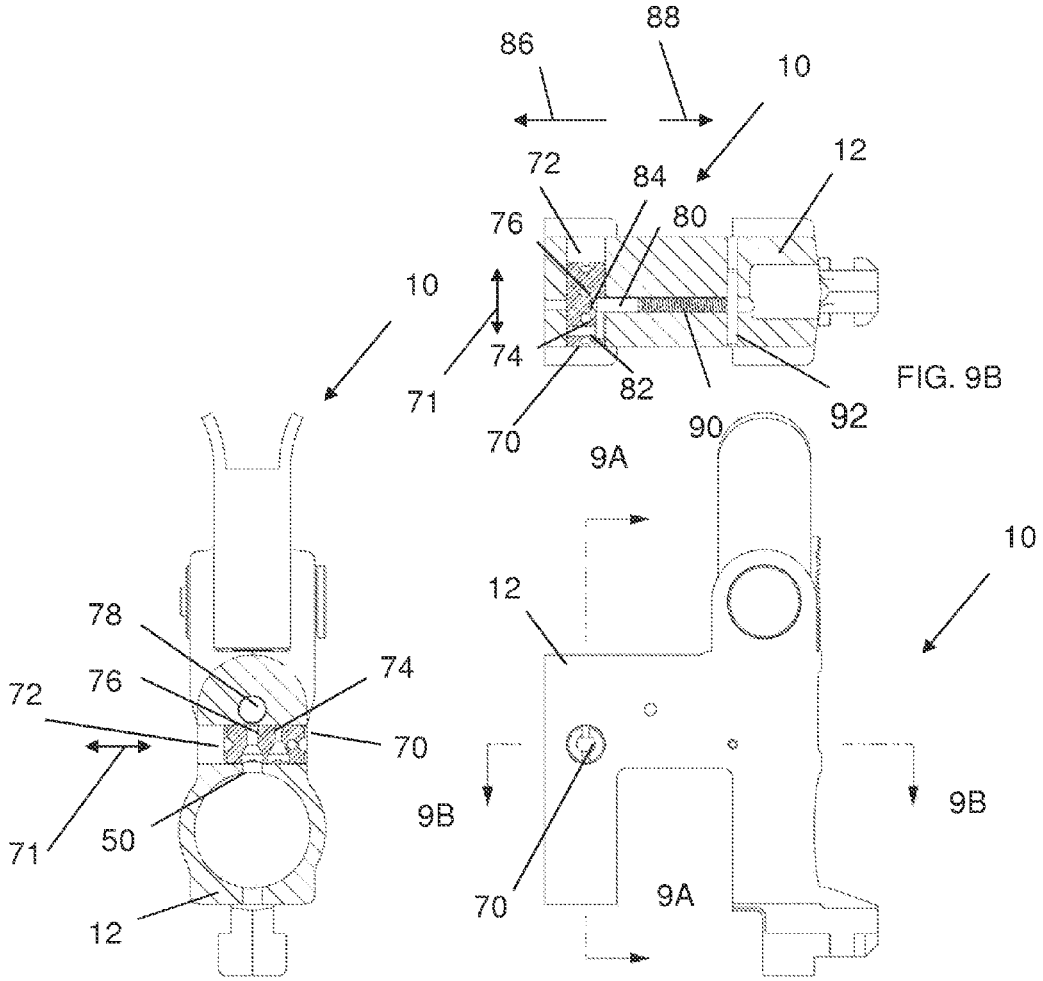

FIGS. 8A-8C illustrate the gas regulator 70 in a first position wherein the first opening 74 is fluidly coupled to opening 50 and another opening 78 that is coupled to the gas operating system (not shown) while FIGS. 9A-9C illustrate the gas regulator 70 in second position wherein the second opening 76 is fluidly coupled to opening 50 and opening 78. Accordingly, the cycling rate of the gas operating system and accordingly the firearm can be varied by varying the position of the gas regulator 70.

In one embodiment and in order to releasably retain the gas regulator 70 in either the first position or the second position a spring biased detent 80 is provided to engage complimentary openings 82 and 84 of the gas regulator 70. As illustrated, the spring biased detent 80 is configured for movement in the direction of arrows 86 and 88 and is biased in the direction of arrow 86 by a spring 90. In one embodiment, spring 90 contacts detent 80 at one end and a retaining pin 92 at the other end.

It is understood that the gas regulator 70 of the embodiment of FIGS. 6-9C can be used alone or in combination with the locking front sight 10. In other words, gas block 12 may be configured with or without locking front sight 10.

Figure 10A:
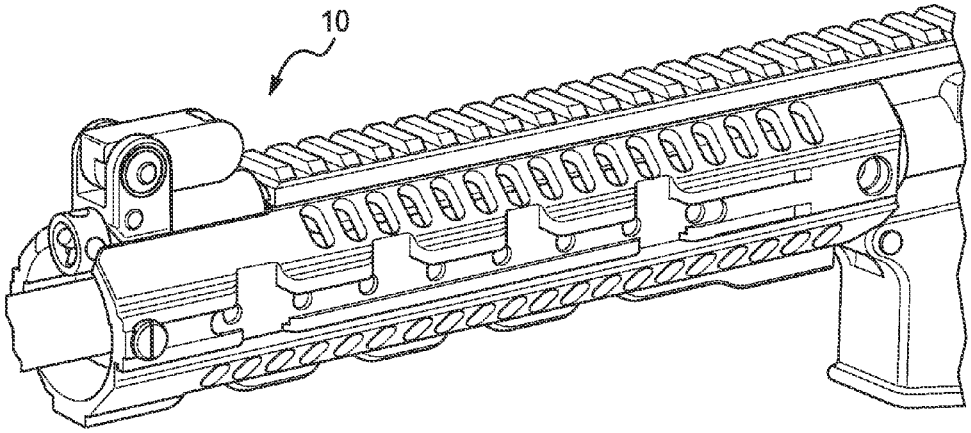
FIGS. 10A and 10B illustrate the locking front sight of various embodiments of the present invention secured to an upper receiver of a firearm.
Figure 10B:
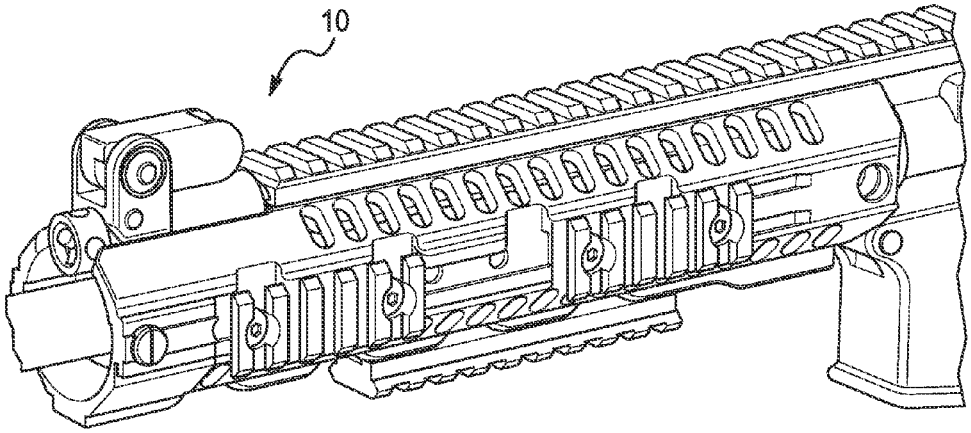
Figure 11:
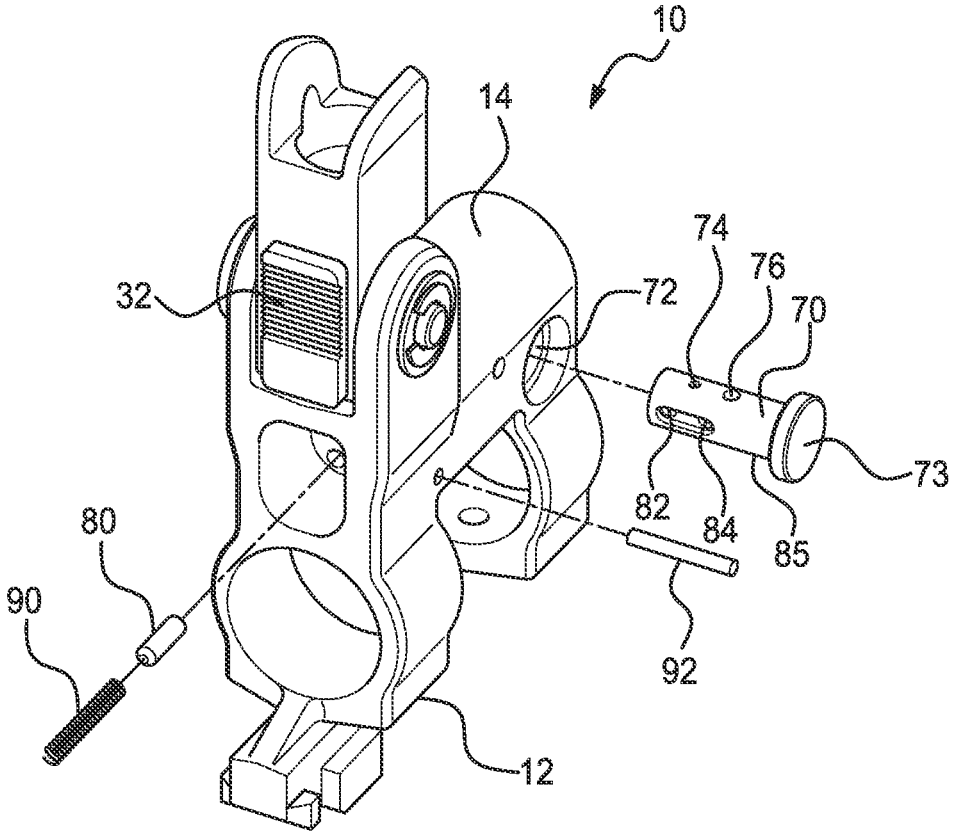
FIGS. 11-14D illustrate yet another alternative embodiment of the present invention.

Referring now to FIGS. 10A and 10B the locking front sight 10 and/or gas block 12 of various embodiments of the present invention is illustrated as being used with an upper receiver 100 of a firearm. In the illustrated embodiment, the upper receiver 100 is a modular upper receiver such as the modular upper receiver described in U.S. Provisional Patent Application Ser. No. 61/481,697, filed May 2, 2011 and U.S. Non-Provisional patent application Ser. No. 13/462,346, filed May 2, 2012, the contents each of which are incorporated herein by reference thereto.

Referring now to FIGS. 11-14D yet another alternative embodiment of the present invention is illustrated. Here and similar to the embodiments of FIGS. 6-9C, the mounting block or gas block 12 is configured to slidably receive a gas regulator 70 in an opening 72 of the mounting block or gas block 12. As illustrated, the gas regulator 70 is capable of movement in the direction of arrows 71 within opening 72. However and in this embodiment, the gas regulator 70 is configured to have an elongated body portion comprising openings 72 and 74 wherein an enlarged head portion 73 is located at one end of the elongated body portion. In addition, opening 72 has recessed area or counter sink portion 75 configured to receive head portion 73 therein when the gas regulator is in a first position.

Gas regulator 70 provides a means for fluidly coupling opening 50 to a gas operating system of the firearm in a manner such that an orifice or opening coupling the bore of the barrel to the gas operating system can be varied such that the cycling rate of the firearm can be varied. In this embodiment, the gas regulator 70 has two openings 74 and 76 each of which has a different size or diameter thus varying the gas pressures or fluid communication between the barrel and the gas operating system if the firearm.

Figures 12A, 12B, 12C:
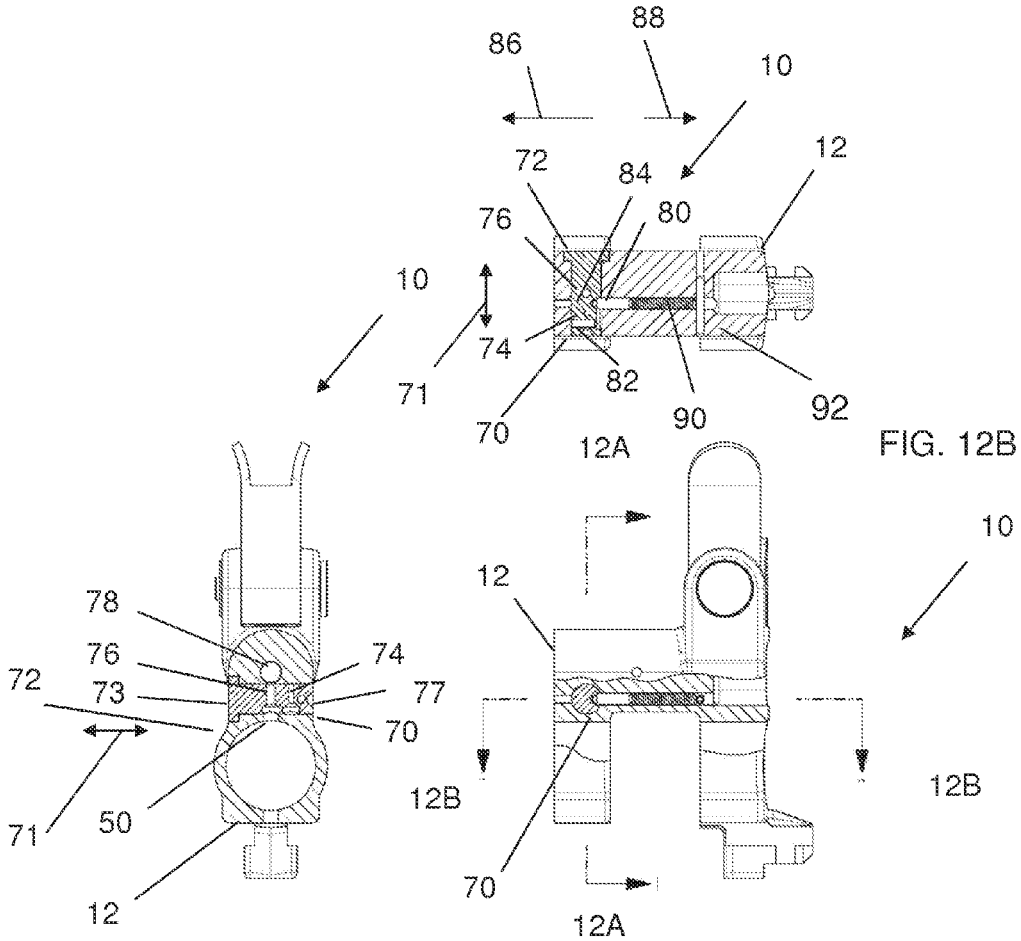
Figures 13A, 13B, 13C:
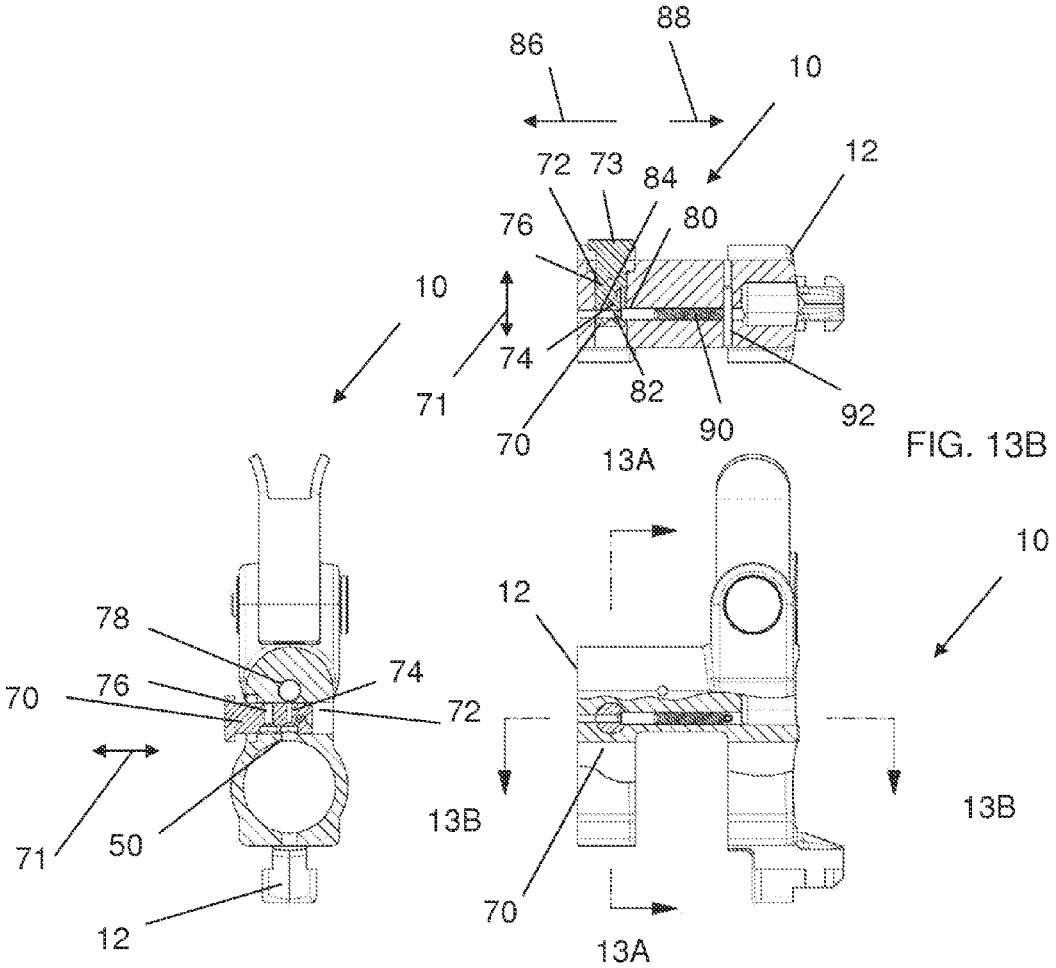
Figure 14A:
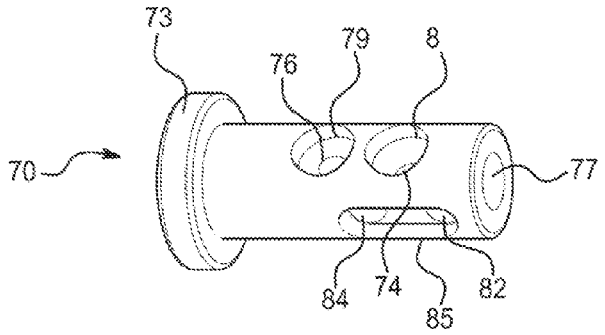
Figure 14B:
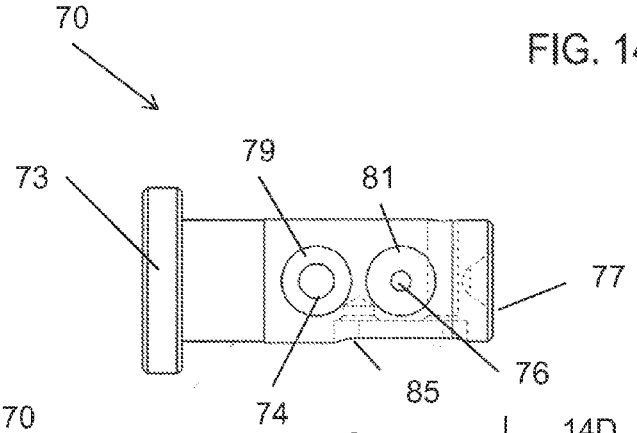
Figure 14C:
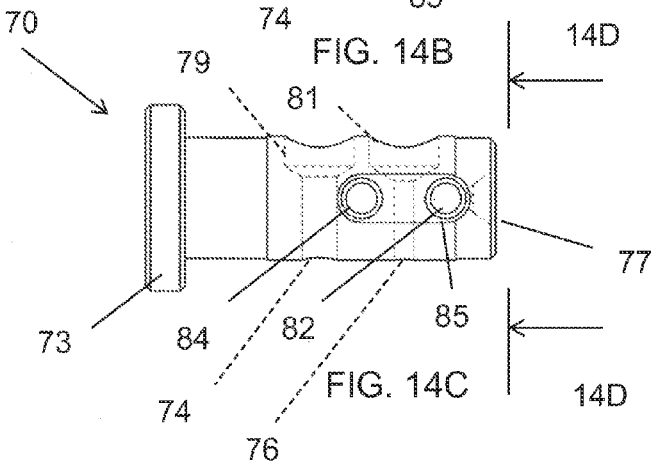
Figure 14D:
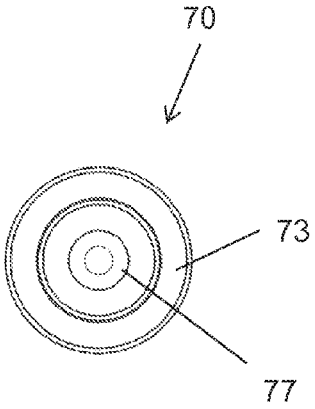

FIGS. 12A-12C illustrate the gas regulator 70 in a first position wherein the first opening 74 is fluidly coupled to opening 50 and another opening 78 that is coupled to the gas operating system (not shown) while FIGS. 13A-13C illustrate the gas regulator 70 in second position wherein the second opening 76 is fluidly coupled to opening 50 and opening 78. Accordingly, the cycling rate of the gas operating system and accordingly the firearm can be varied by varying the position of the gas regulator 70 as the sizes of openings 74 and 76 vary.

Still further and as illustrated in FIGS. 12A-12C and when the gas regulator 70 is in the first position, the head portion 73 of the gas regulator 70 is received within recessed area or counter sink portion 75 such that head portion 73 is flush with a surface of the gas block 12. Conversely and as illustrated in FIGS. 13A-13C and when the gas regulator 70 is in the second position, the head portion 73 of the gas regulator 70 is not received within recessed area or counter sink portion 75 such that head portion 73 protrudes from the surface of the gas block 12. Accordingly, an operator of the rifle will be able to discern the operational position of the gas regulator 70 (e.g., a first position and/or second position) by simply positioning one of their fingers or thumb proximate to the gas block 12. Therefore, this embodiment provides a tactile means for determining the operational position of the gas regulator 70.

In addition and when the gas regulator 70 is in the second position, the protruding head portion 73 provides a surface for applying a user applied force to move the gas regulator from the second position to the first position. On the other hand, the opposite end of the gas regulator 70 has a recess 77 that allows an operator to insert an object such as a round of ammunition into opening 72 via an opposite side of the gas block 12 and reposition the gas regulator from the first position into the second position.

In one embodiment and in order to releasably retain the gas regulator 70 in either the first position or the second position a spring biased detent 80 is provided to engage complimentary openings 82 and 84 of the gas regulator 70.

As illustrated, the spring biased detent 80 is configured for movement in the direction of arrows 86 and 88 and is biased in the direction of arrow 86 by a spring 90. In one embodiment, spring 90 contacts detent 80 at one end and a retaining pin 92 at the other end. In addition and in this embodiment, openings 82 and 84 are located within a recessed area 85 located on gas regulator 70. This recessed area or undercut area 85 prevents carbon buildup within opening 72 from impeding the movement of gas regulator 70 within opening 72.

FIGS. 14A-14D are various views of the gas regulator 70 according to one embodiment. In this embodiment, each end of the openings 74 and 76 that are in direct fluid communication with opening 50 are located within a recessed area or counter sink portion 79 and 81, respectively.

Figure 15:
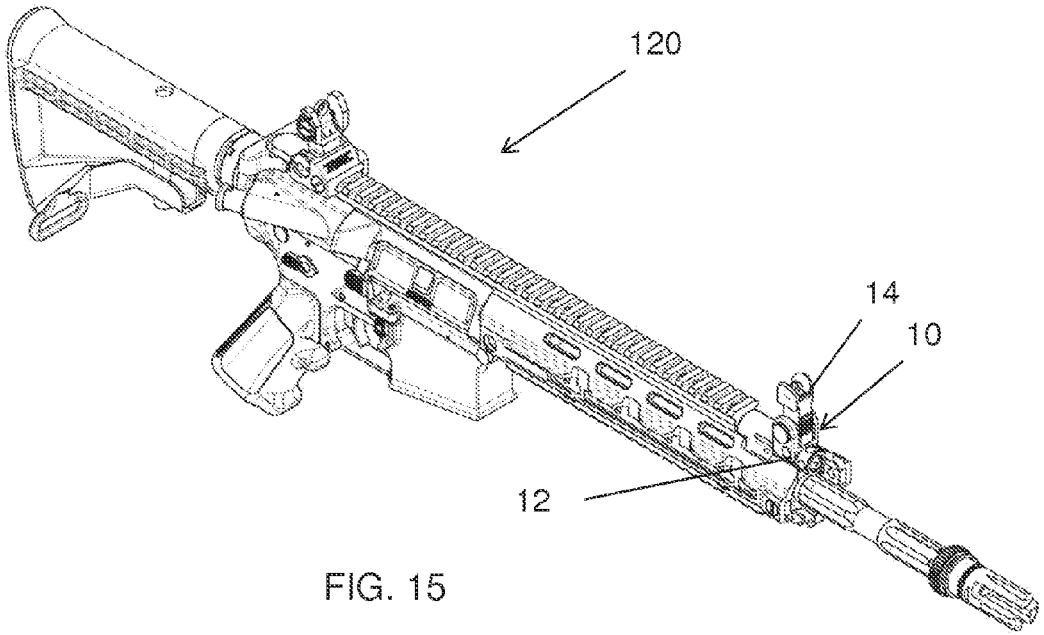
FIG. 15 illustrates a firearm according to various embodiments of the present invention.

It is understood that the gas regulator 70 of the embodiments illustrated in at least FIGS. 6-9C and 11-14C can be used alone or in combination with the locking front sight 10. In other words, gas block 12 may be configured with or without locking front sight 10. FIG. 15 illustrates a non-limiting firearm 120 according to various embodiments of the present invention. In various non-limiting embodiments the firearm may be anyone of gas operated, piston or hybrid, automatic or semi-automatic, non-limiting examples include the M-4 or M-16 type or similar commercial variants thereof as well as other types of firearms described in above mentioned patents as well as U.S. Pat. No. 5,726,377, the contents of which are also incorporated herein by reference thereto.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. A gas regulator for a rifle, comprising:

an elongated member having a first end and a second end;

a head portion located at the first end, the head portion having a diameter larger than a diameter of the elongated member;

a pair of openings passing through the elongated member, wherein one of the openings of the pair of openings is larger than the other one of the openings of the pair of openings;

a recess area located at the second end;

a gas block, wherein the elongated member is slidably received within an opening of the gas block for linear movement between a first position and a second position, wherein one of the openings of the pair of openings through the elongated member provides fluid communication between a pair of openings in the gas block when the elongated member is in the first position and another one of the pair of openings through the elongated member provides fluid communication between the pair of openings in the gas block when the elongated member is in the second position, wherein the head portion is received within a counter sink portion of the gas block and is flush with the gas block when the elongated member is in the first position and wherein the head portion protrudes from the gas block when the elongated member is in the second position, wherein one end of each one of the openings of the pair of openings passing through the elongated member is in fluid communication with one of a pair of second recessed areas of the elongated member via a transition area, the pair of second recessed areas being located between the first end and the second end of the elongated member and the pair of second recessed areas each having a diameter greater than a diameter of the pair of openings passing through the elongated member.

2. The gas regulator as in claim 1, further comprising a pair of detent openings located on a portion of the elongated member, the pair of detent openings both being located within a first recessed area located between the first end and the second end of the elongated member.

3. The gas regulator as in claim 1, further comprising a spring biased detent configured to releasably retain the elongated member in the first and second positions by engaging a pair of detent openings located on a portion of the elongated member, the pair of detent openings both being received within a first recessed area located between the first end and the second end of the elongated member.

4. The gas regulator as in claim 1, further comprising: a locking sight pivotally secured to the gas block for movement between a first position and a second position; a first locking mechanism comprising a plurality of spring biased members for retaining the sight in the first position and the second position, the plurality of spring biased members being configured to allow for movement of the sight between the first position and the second position in response to a force applied to the sight; and a second locking mechanism configured to lock the sight in the second position and unlock the sight such that it may be moved from the second position, wherein the second locking mechanism must be manually released before the sight can be moved from the second position to the first position, wherein the sight is located proximate to a forward end of the rifle.

5. The gas regulator as in claim 1, wherein the gas block is configured to be mounted about a barrel of a rifle and wherein one of the openings of the pair of openings of the gas block is in fluid communication with the barrel when the gas block is mounted about the barrel.

6. The gas regulator as in claim 5, wherein the rifle is an automatic or semi-automatic rifle.

7. The gas regulator as in claim 5, further comprising: a spring biased detent configured to releasably retain the elongated member in the first and second positions by engaging a pair of detent openings located on a portion of the elongated member, the pair of detent openings both being received within a first recessed area located between the first end and the second end of the elongated member; a locking sight pivotally secured to the gas block for movement between a first position and a second position; a first locking mechanism comprising a plurality of spring biased members for retaining the sight in the first position and the second position, the plurality of spring biased members being configured to allow for movement of the sight between the first position and the second position in response to a force applied to the sight; and a second locking mechanism configured to lock the sight in the second position and unlock the sight such that it may be moved from the second position, wherein the second locking mechanism must be manually released before the sight can be moved from the second position to the first position, wherein the sight is located proximate to a forward end of the rifle.

8. A gas block for a rifle, comprising:

a gas regulator having a first end and a second end;

a pair of openings passing through the gas regulator, wherein one of the openings of the pair of openings is larger than the other one of the openings of the pair of openings; and wherein the gas regulator is slidably received within an opening of the gas block for linear movement between a first position and a second position, wherein one of the openings of the pair of openings through the gas regulator provides fluid communication between a pair of openings in the gas block when the gas regulator is in the first position and another one of the openings of the pair of openings through the gas regulator provides fluid communication between the pair of openings in the gas block when the gas regulator is in the second position, wherein the gas regulator comprises a head portion located at the first end, the head portion having a diameter larger than a diameter of the gas regulator, wherein the head portion is received within a counter sink portion of the gas block and is flush with the gas block when the gas regulator is in the first position and wherein the head portion protrudes from the gas block when the gas regulator is in the second position, wherein one end of each one of the openings of the pair of openings passing through the gas regulator is in fluid communication with one of a pair of second recessed areas of the gas regulator via a transition area, the pair second recessed areas being located between the first end and the second end of the gas regulator and the pair of second recessed areas each having a diameter greater than a diameter of the pair of openings passing through the gas regulator.

9. The gas block as in claim 8, further comprising a spring biased detent configured to releasably retain the gas regulator in the first and second positions by engaging a pair of detent openings located on a portion of the gas regulator, the pair of detent openings both being located within a first recessed area located between the first end and the second end of the gas regulator.

10. A rifle, comprising:

a barrel;

a gas block having a pair of openings wherein one of the pair of openings is in fluid communication with the barrel;

a gas regulator having a first end and a second end;

a pair of openings passing through the gas regulator, wherein one of the openings of the pair of openings passing through the gas regulator is larger than the other one of the openings of the pair of openings passing through the gas regulator; and wherein the gas regulator is slidably received within an opening of the gas block for linear movement between a first position and a second position, wherein one of the openings of the pair of openings through the gas regulator provides fluid communication between the pair of openings in the gas block when the gas regulator is in the first position and another one of the openings of the pair of openings through the gas regulator provides fluid communication between the pair of openings in the gas block when the gas regulator is in the second position and wherein the gas regulator further comprises a head portion located at the first end, the head portion having a diameter larger than a diameter of the gas regulator, wherein the head portion is received within a counter sink portion of the gas block and is flush with the gas block when the gas regulator is in the first position and wherein the head portion protrudes from the gas block when the gas regulator is in the second position, wherein one end of each one of the openings of the pair of openings passing through the gas regulator is in fluid communication with one of a pair of second recessed areas of the gas regulator via a transition area, the pair second recessed areas being located between the first end and the second end of the gas regulator and the pair of second recessed areas each having a diameter greater than a diameter of the pair of openings passing through the gas regulator.

* * * * *